US010413011B2

(12) United States Patent
Jordan

(10) Patent No.: US 10,413,011 B2
(45) Date of Patent: Sep. 17, 2019

(54) HARDHAT SPEAKERS

(71) Applicant: Charlie Lee Jordan, Blue Island, IL (US)

(72) Inventor: Charlie Lee Jordan, Blue Island, IL (US)

( * ) Notice: Subject to any disclaimer, the term of this patent is extended or adjusted under 35 U.S.C. 154(b) by 0 days.

(21) Appl. No.: 16/256,867

(22) Filed: Jan. 24, 2019

(65) Prior Publication Data

US 2019/0231020 A1 Aug. 1, 2019

Related U.S. Application Data

(60) Provisional application No. 62/623,051, filed on Jan. 29, 2018.

(51) Int. Cl.

| | |
|---|---|
| ***A42B 3/30*** | (2006.01) |
| ***H04R 1/02*** | (2006.01) |
| ***H04R 1/34*** | (2006.01) |

(52) U.S. Cl.

CPC ..... *A42B 3/306* (2013.01); *H04R 1/026* (2013.01); *H04R 1/028* (2013.01); *H04R 1/345* (2013.01); *H04R 2420/07* (2013.01)

(58) Field of Classification Search

CPC ..... A42B 3/306; H04R 1/026; H04R 1/028; H04R 1/345; H04R 2420/07

See application file for complete search history.

(56) References Cited

U.S. PATENT DOCUMENTS

2014/0355807 A1* 12/2014 McDowell ..... H04R 1/02 381/334

* cited by examiner

*Primary Examiner* — Mark Fischer

(74) *Attorney, Agent, or Firm* — Ellenoff Grossman & Schole LLP; James M. Smedley, Esq

(57) ABSTRACT

Apparatus and associated methods relate to a wireless audio speaker module configured to play music at a volume level that will not disturb those nearby, based on adapting a wireless audio speaker to be retained within headgear, adjusting the volume of sound emitted by the speaker to a level that will not disturb those nearby, and amplifying the speaker sound as a function of the headgear interior reflecting the sound emitted by the speaker to the user's ear. In an illustrative example, an airgap may be configured between the speaker and the headgear user's ear. In various embodiments, the sound volume emitted by the speaker may be adjusted to avoid disturbing those nearby. In some examples, the headgear may be a hardhat, advantageously configured with a wireless audio speaker module to permit construction workers to listen to music amplified by reflection within their hardhats without disturbing or distracting each other.

20 Claims, 5 Drawing Sheets

HARDHAT SPEAKERS

CROSS-REFERENCE TO RELATED APPLICATIONS

This application claims the benefit of U.S. Provisional Application No. 62/623,051, titled "HardBeatz Bluetooth Speaker," filed by Charlie Jordan, Applicant, on Jan. 29, 2018; Inventor: Charlie Jordan.

This application incorporates the entire contents of the above-referenced application herein by reference.

TECHNICAL FIELD

Various embodiments relate generally to portable wireless audio speakers.

BACKGROUND

Audio speakers are audio transducers. A transducer may convert an audio signal into sound waves. Some audio speakers convert signals into sound waves audible to a user. Users of audio speakers include individuals, businesses, organizations, and facilities. For example, a person may listen to music using an audio speaker connected to a music player. Some audio speakers are portable. In various scenarios, portable speakers may be configured with wireless interfaces. Portable speakers with wireless interfaces may permit multiple individuals near a common location to listen to different music or other programming.

In an illustrative example, the music or program chosen for listening by some users may not align with the preference of other users near the same location. Some users may prefer to wear earplugs to block music they do not want to listen to, or use earbuds or headphones to privately listen to their preferred music. In some examples, workers at construction site locations may wish to listen to music while working, without disturbing each other. However, construction site safety restrictions may require that the workers wear hardhats for protection against injury. If an individual at a construction site were to wish to listen to music using earphones, headphones, earbuds, or the like, it may be difficult, or impossible, to do so while wearing a hardhat.

In some exemplary scenarios, the use of earbuds or other in-ear listening devices may distract users from their surroundings, leading to increased danger on a construction site. In an illustrative example, some construction site safety restrictions may prohibit users from using earbuds or headphones, to avoid dangerous distractions. A group of construction workers may have to choose whether all should listen to the same music, or not have music at all.

SUMMARY

Apparatus and associated methods relate to a wireless audio speaker module configured to play music at a volume level that will not disturb those nearby, based on adapting a wireless audio speaker to be retained within headgear, adjusting the volume of sound emitted by the speaker to a level that will not disturb those nearby, and amplifying the speaker sound as a function of the headgear interior reflecting the sound emitted by the speaker to the user's ear. In an illustrative example, an airgap may be configured between the speaker and the headgear user's ear. In various embodiments, the sound volume emitted by the speaker may be adjusted to avoid disturbing those nearby. In some examples, the headgear may be a hardhat, advantageously configured with a wireless audio speaker module to permit construction workers to listen to music amplified by reflection within their hardhats without disturbing or distracting each other.

Various embodiments may achieve one or more advantages. For example, some embodiments may improve a user's ease of listening to music while working, or when accompanied by others nearby. This facilitation may be a result of reducing the user's effort adjusting listening devices and configuring audio speakers in the user's workplace environment. Various embodiments may reduce the potential for workplace disagreement resulting from worker music preference differences. Such reduced potential for workplace disagreement may be a result of a wireless audio speaker module configured to play music at a volume level that will not disturb those nearby, permitting each worker to privately listen to music aligned with their individual preference.

Some embodiments may reduce the potential for dangerous workplace distraction. This facilitation may be a result of a wireless audio speaker module retained within a user's headgear and positioned to increase the speaker sound incident on the user's ear, based on the headgear interior reflecting sound emitted by the speaker to the user's ear. In some examples, the sound pressure emitted directly from the speaker, measured at a point outside the helmet, may be maintained lower than the total sound pressure reaching the user's ear. In an illustrative example, the total sound pressure reaching a user's ear may include first sound energy emitted directly from the speaker, plus second sound energy reflected from the headgear interior to the user's ear. In various scenarios, amplifying the speaker sound from the perspective of the user's ear, without increasing the apparent volume outside the headgear, may be a result of positioning the speaker within the headgear to reflect such second sound energy from the headgear interior to the user's ear. Some embodiments may improve workplace safety. Such improved workplace safety may be a result of a wireless audio speaker module retained within a worker's headgear and configured with an airgap between the speaker and the user's ear, permitting the user to hear sounds from nearby sources while listening to music from the speaker.

The details of various embodiments are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

To aid understanding, this document is organized as follows. First, a wireless audio speaker module adapted to play music without disturbing those nearby, based on amplifying the speaker sound by reflection from the interior of headgear retaining the speaker, is briefly introduced with reference to FIG. 1. Second, with reference to FIGS. 2-4, the discussion turns to exemplary embodiments that illustrate wireless audio speaker module design implementations. Specifically, embodiment wireless audio speaker module housing, installation, and control designs are presented. Then, with reference to FIG. 5, an illustrative structural block diagram of an embodiment wireless audio speaker module is described.

Figure 1:
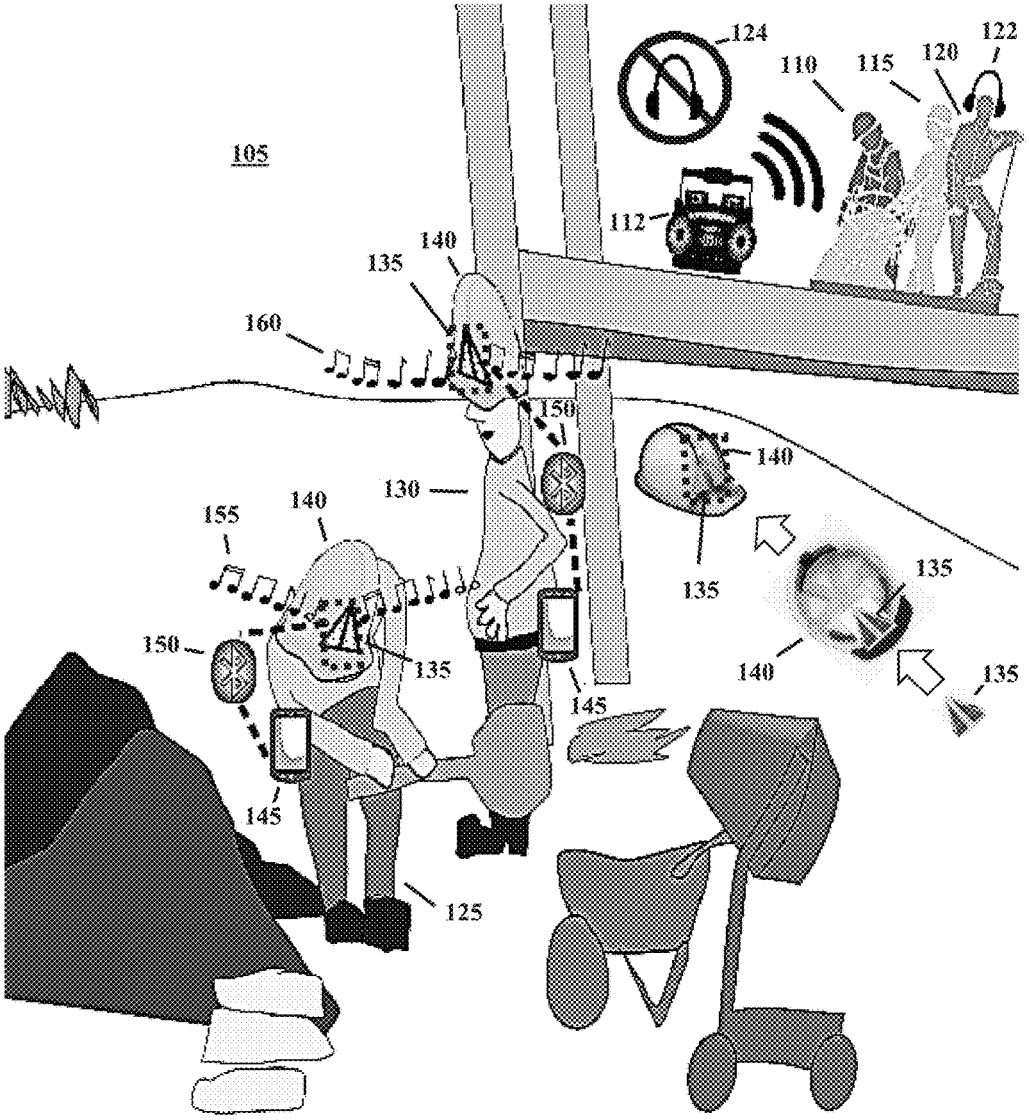
FIG. 1 depicts an illustrative operational scenario wherein a user employs an exemplary wireless audio speaker module configured to play music at a volume level that will not disturb those nearby, based on adapting a wireless audio speaker to be retained within headgear, adjusting the volume of sound emitted by the speaker to a level that will not disturb those nearby, and amplifying the speaker sound as a function of the headgear interior reflecting the sound emitted by the speaker to the user's ear.

FIG. 1 depicts an illustrative operational scenario wherein a user employs an exemplary wireless audio speaker module configured to play music at a volume level that will not disturb those nearby, based on adapting a wireless audio speaker to be retained within headgear, adjusting the volume of sound emitted by the speaker to a level that will not disturb those nearby, and amplifying the speaker sound as a function of the headgear interior reflecting the sound emitted by the speaker to the user's ear. In the example depicted by FIG. 1, work is in progress at the construction site 105 while the worker 110 configures the boombox 112 to play music. The worker 115 does not like the music played by the worker 110 through the boombox 112, leading to a workplace dispute between the worker 110 and the worker 115 concerning music preferences. In the depicted example, the worker 120 wishes to privately listen to his preferred music using the headphones 122, however in-ear listening devices are prohibited by safety restriction 124 at the construction site 105. In the illustrated example, the worker 125 and worker 130 are also working at the construction site 105. In the depicted example, the worker 125 configures an embodiment hardhat speaker 135 in his hardhat 140. In the illustrated example, the worker 130 also configures an embodiment hardhat speaker 135 in his hardhat 140. In the illustrated example, the embodiment hardhat speakers 135 are adapted to install inside the exemplary hardhats 140. In various examples, embodiment hardhat speakers 135 may be adapted to install outside the hardhat 140. In the depicted embodiment, the exemplary hardhat speakers 135 are configured in an exemplary triangular-prism-shaped housing adapted to be inserted within an illustrative hardhat's suspension bands. In the illustrated embodiment, the exemplary hardhat speakers 135 are configured within the illustrative hardhats 140 with an air gap between the speakers and the user's ear, permitting the users to hear sounds from the external environment while listening to music from the hardhat speakers 135. In the depicted embodiment, the worker 125 smartphone 145 is paired via the Bluetooth link 150 to the embodiment hardhat speaker 135 to privately play music 155 in the worker 125 hardhat 140. In the illustrated embodiment, the worker 130 smartphone 145 is paired via the Bluetooth link 150 to the embodiment hardhat speaker 135 to privately play music 160 in the worker 130 hardhat 140. In the depicted embodiment, the hardhat speakers 135 are removably retained by hook and loop fasteners within the hardhats 140 worn by worker 125 and worker 130. In the illustrated embodiment, the hardhat speakers 135 are positioned inside the hardhats 140 to increase the hardhat speaker 135 sound incident on the user's ears, based on the hardhat 140 interior reflecting sound emitted by the hardhat speaker 135 to the user's ear. In various examples, an embodiment hardhat speaker 135 may include one or more audio speaker disposed at an angle configured to use the hardhat interior as an amplifier based the hardhat interior reflecting the sound emitted by the speaker to the user's ear, permitting the volume of sound emitted by the speaker to be adjusted to a sound level that will not disturb those nearby while permitting the user wearing the hardhat to privately listen to music while working. In an illustrative example, some embodiment hardhat speakers may include audio speakers positioned at an advantageous sound reflection angle conformant with a prism side surface of an embodiment triangular-prism-shaped hardhat speaker 135 housing.

Figure 2A:
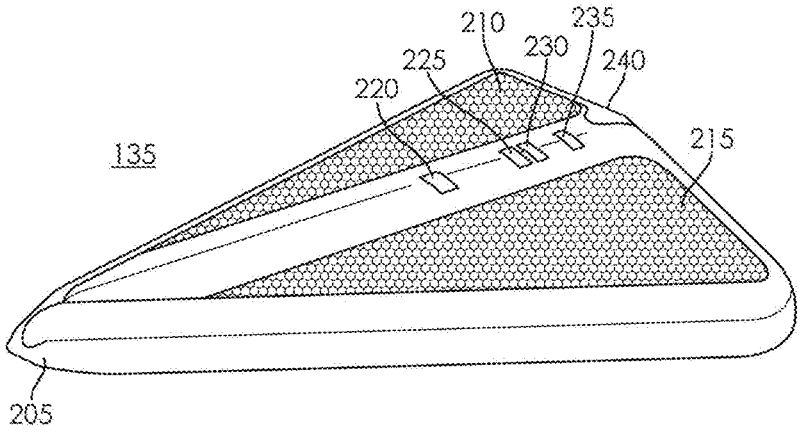
FIG. 2A depicts an illustrative side perspective view of an exemplary wireless audio speaker module configured to play music at a volume level that will not disturb those nearby.

FIG. 2A depicts an illustrative side perspective view of an exemplary wireless audio speaker module configured to play music at a volume level that will not disturb those nearby. In FIG. 2A, the exemplary hardhat speaker 135 includes the substantially triangular-prism-shaped housing 205. In the depicted embodiment, the illustrative hardhat speaker 135 housing 205 includes the left speaker 210 disposed in the housing 205 prism left side surface to emit sound dispersed from a plane conformant with the housing 205 prism left side surface. In the illustrated embodiment, the left speaker 210 is configured at an angle to advantageously direct speaker sound to a hardhat interior surface to be reflected to a user's ear within the hardhat. In the depicted embodiment, the illustrative hardhat speaker 135 housing 205 includes the right speaker 215 disposed in a housing 205 prism right side surface to emit sound dispersed from a plane conformant with the housing 205 prism right side surface. In the illustrated embodiment, the right speaker 215 is configured at an angle to advantageously direct speaker sound to a hardhat interior surface to be reflected to a user's ear within the hardhat. In various examples, the housing 205 may include an aperture adapted to facilitate sound conduction to the ambient environment by the right speaker 215 or left speaker 210 configured in the housing 205. In the depicted embodiment, the housing 205 also includes an aperture adapted to enable operational user access to power button 220 operably coupled with a wireless audio transceiver configured in the exemplary hardhat speaker 135. In the illustrated embodiment, the housing 205 is configured with apertures adapted to enable operational user access to volume up button 225 and volume down button 230. In the depicted example, the volume up button 225 and volume down button 230 are operably coupled with the wireless audio transceiver configured in the exemplary hardhat speaker 135. In some embodiments, the housing 205 may be configured with one or more aperture adapted to enable operational user access to one or more button configured to control an external media device operably linked with the wireless audio transceiver. For example, the one or more control configured to control an external media device may enable a user to perform an operation such as, for example, selecting a particular song to be played in the exemplary hardhat speaker 135. In the depicted embodiment, the housing 205 is configured with an aperture permitting user visual access to the indicator light 235 operably coupled with the wireless audio transceiver configured in the exemplary hardhat speaker 135. In various embodiments, the indicator light 235 may be a multi-color multi-function indicator light. In the depicted example, the indicator light 235 is configured to glow blue when the wireless transceiver is pairing. In some designs, an exemplary hardhat speaker 135 may include a rechargeable battery. In the depicted embodiment, the charging port 240 is operably coupled with the wireless audio transceiver configured in the exemplary hardhat speaker 135 to charge the battery. In the depicted embodiment, the charging port is a USB connector. In various embodiments, the charging port may be any suitable connector type. In the illustrated embodiment, the indicator light 235 is configured to glow green when a battery configured in the hardhat speaker 135 is charged. In the depicted embodiment, the indicator light 235 is configured to glow red when a battery configured in the hardhat speaker 135 is low. In some embodiments, the indicator light may be configured to blink in various color or duty cycle modes to represent various hardhat speaker 135 states.

Figure 2B:
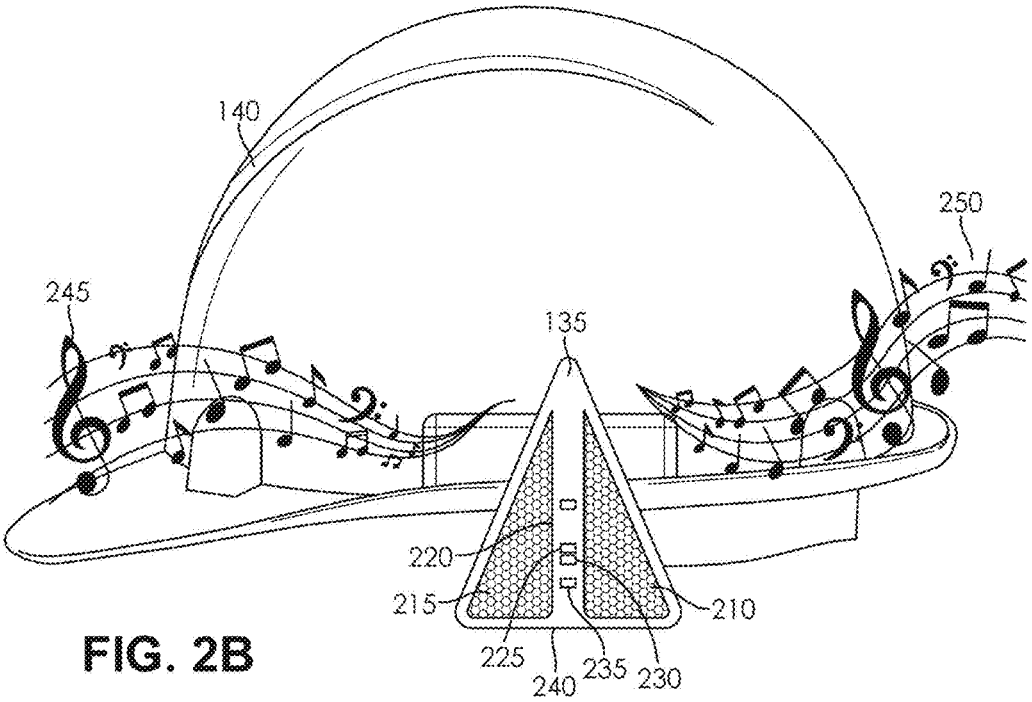
FIG. 2B depicts an illustrative side view of an embodiment wireless audio speaker module illustrated with exemplary headgear.

FIG. 2B depicts an illustrative side view of an embodiment wireless audio speaker module illustrated with exemplary headgear. In FIG. 2B, in an illustrative example, the depicted embodiment hardhat speaker 135 is operably linked with a media device playing stereo music through the hardhat 140 speaker 135. In the depicted example, the hardhat speaker 135 right speaker 215 plays music channel 245 as one of a pair of audio channels received in stereo from a media device via a Bluetooth link operably coupling the hardhat speaker 135 wireless audio transceiver with the media device. In the depicted example, the hardhat speaker 135 left speaker 210 plays music channel 250 as one of a pair of audio channels received in stereo from a media device via a Bluetooth link operably coupling the hardhat speaker 135 wireless audio transceiver with the media device.

Figure 3A:
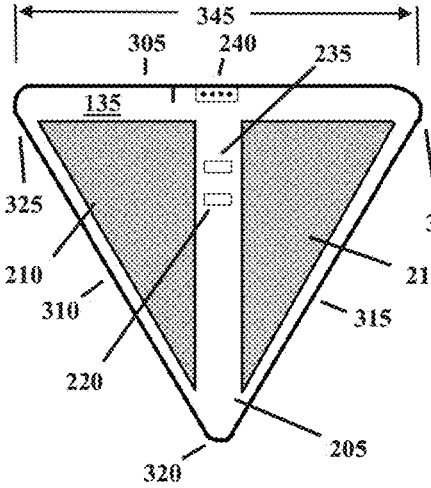
FIG. 3A depicts an illustrative front view of an exemplary wireless audio speaker module.

FIG. 3A depicts an illustrative front view of an exemplary wireless audio speaker module. In FIG. 3A, the exemplary hardhat speaker 135 front view includes the housing 205 triangle base sidewall 305, the housing 205 triangle left sidewall 310, and the housing 205 triangle right sidewall 315. In the depicted embodiment, the housing 205 triangle central vertex 320 defines a point on a line colinear with the housing central axis and housing 205 triangle height, in alignment with the power button 220 and indicator light 235, disposed between the left speaker 210 and the right speaker 215, and perpendicular to the housing 205 triangle base sidewall 305. In the illustrated embodiment, the housing 205 triangle left vertex 325 is disposed at the distal end of the housing 205 triangle base sidewall 305 from the housing 205 triangle right vertex 330.

Figure 3B:
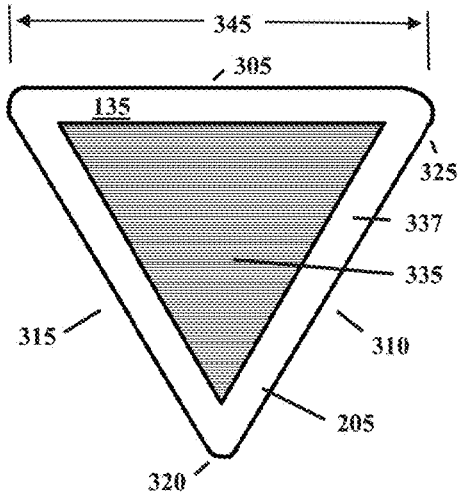
FIG. 3B depicts an illustrative rear view of an exemplary wireless audio speaker module.

FIG. 3B depicts an illustrative rear view of an exemplary wireless audio speaker module. In FIG. 3B, the exemplary hardhat speaker 135 rear view includes the fastener 335 configured to removably secure the depicted hardhat speaker 135 rear surface 337 to an illustrative hardhat interior surface. In the depicted embodiment, the fastener 335 is a hook and loop fastener configured in the hardhat speaker 135 rear surface 337. In various embodiments, the fastener 335 may be any fastener suitable to removably secure the hardhat speaker 135 rear surface 337 to a hardhat surface. In various embodiments, the housing 205 triangle height dimension 340 may be any suitable dimension adapted to facilitate installation into preferred headgear. In the depicted example, the housing 205 triangle height dimension 340 is approximately three inches. In some embodiments, the housing 205 triangle base sidewall 305 dimension 345 may be any suitable dimension adapted to facilitate installation into preferred headgear. In the illustrated embodiment, the housing 205 triangle base sidewall 305 dimension 345 is approximately two inches.

Figure 3C:
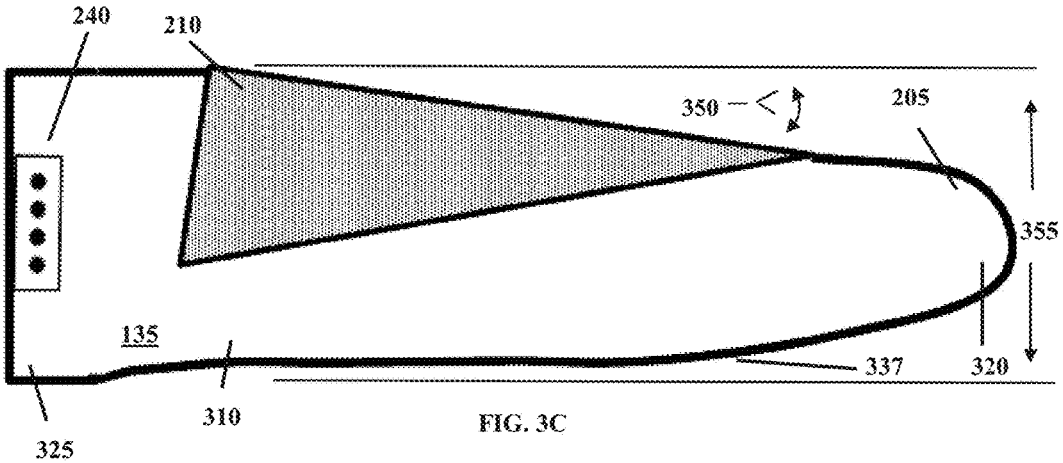
FIG. 3C depicts an illustrative side view of an exemplary wireless audio speaker module.

FIG. 3C depicts an illustrative side view of an exemplary wireless audio speaker module. In FIG. 3C, the exemplary hardhat speaker 135 left side view includes the left speaker 210 outer surface configured at an angle 350 with a line parallel to and distal by the thickness dimension 355 from the hardhat speaker 135 rear surface 337. In various embodiments, the angle 350 between the left speaker 210 outer surface and the hardhat speaker 135 rear surface may be any angle suitable to direct sound from the speaker to an illustrative hardhat interior to be reflected by the hardhat interior to a user's ear within the hardhat. In the depicted embodiment, the placement, disposition, and dimensioning of the right speaker 215 is not shown for clarity of illustration, however such placement, disposition, and dimensioning of the right speaker 215 is similar and symmetrical with that of the left speaker 210 in the housing 205. In various embodiments, the exemplary hardhat speaker 135 thickness dimension 355 may be any dimension suitable for efficient installation within an illustrative hardhat. In the depicted embodiment, the exemplary hardhat speaker 135 thickness dimension 355 is approximately two inches.

Figure 3D:
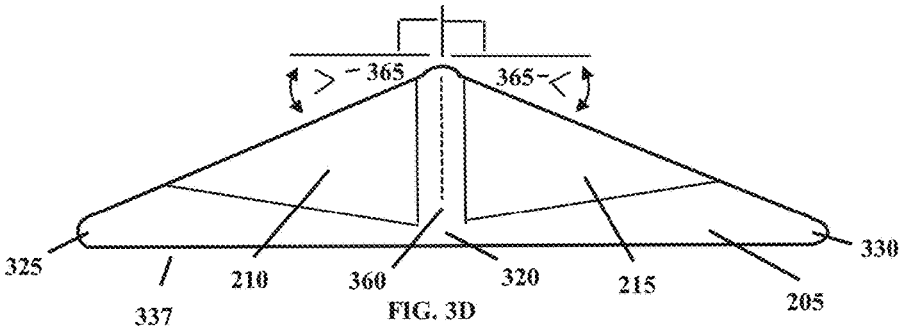
FIG. 3D depicts an illustrative top view of an exemplary wireless audio speaker module.

FIG. 3D depicts an illustrative top view of an exemplary wireless audio speaker module. In FIG. 3D, the exemplary hardhat speaker 135 top view is given from a point of view looking from the housing 205 triangle central vertex 320 along the housing 205 central axis 360 toward the housing 205 triangle base sidewall 305. In the depicted example, the left speaker 210 and the right speaker 215 are disposed in the housing 205. In the illustrated example, the left speaker 210 surface and the right speaker 215 surface form prism side surfaces of the housing 205. In the depicted embodiment, the left speaker 210 surface is disposed at an angle 365 with a line perpendicular to the housing 205 central axis 360 and opposite by the thickness dimension 355 the housing 205 rear surface 337. In the illustrated embodiment, the right speaker 215 surface is disposed at an angle 365 between a line perpendicular to the housing 205 central axis 360 and opposite by the thickness dimension 355 the housing 205 rear surface 337. In various embodiments, the angle 365 may be any angle suitable to direct sound from the speaker to an illustrative hardhat interior to be reflected by the hardhat interior to a user's ear within the hardhat.

Figure 4:
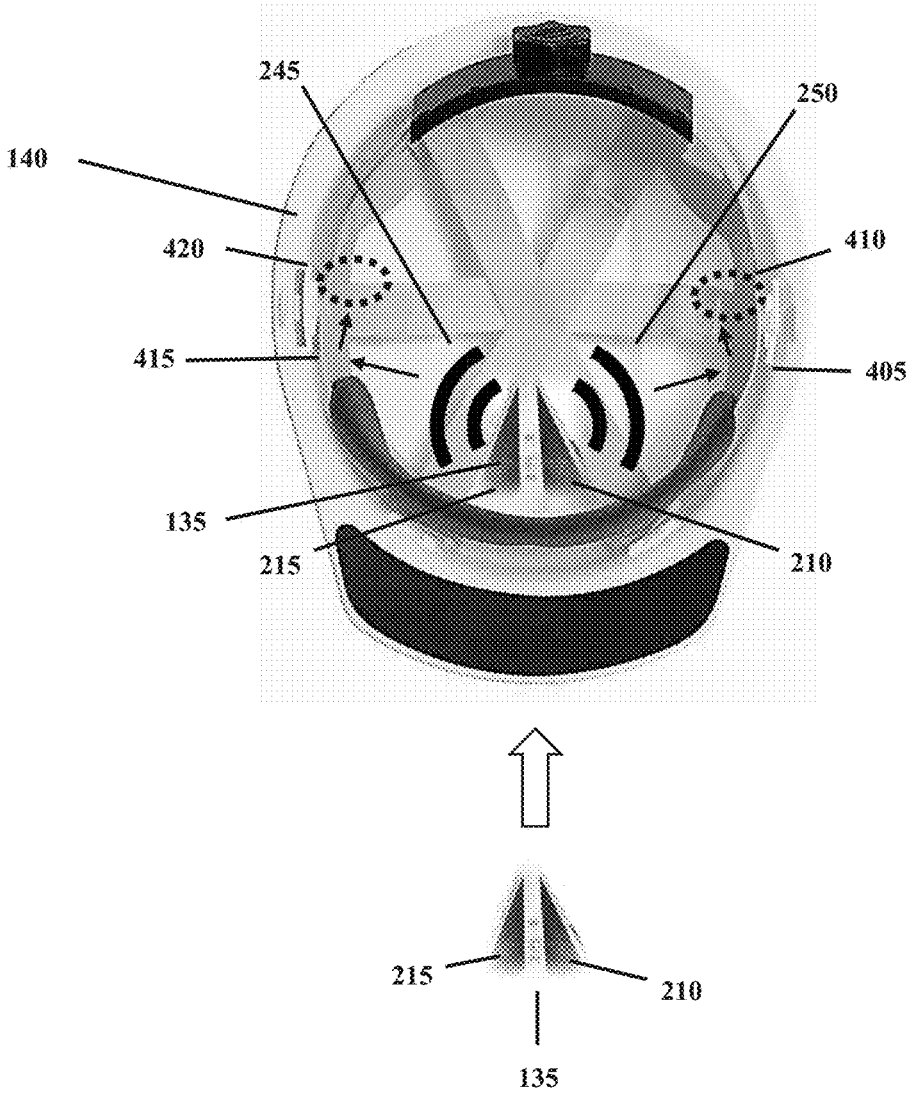
FIG. 4 depicts an illustrative usage scenario wherein an exemplary hardhat is configured with an embodiment wireless audio speaker module adapted to be retained within the hardhat and reflect sound emitted by the speaker to a hardhat user's ear.

FIG. 4 depicts an illustrative usage scenario wherein an exemplary hardhat is configured with an embodiment wireless audio speaker module adapted to be retained within the hardhat and reflect sound emitted by the speaker to a hardhat user's ear. In FIG. 4, the exemplary hardhat speaker 135 is configured in the illustrative hardhat 140 with the left speaker 210 emitting sound waves 250 reflected by the left hardhat interior reflecting region 405 toward the user's ear location 410 within the hardhat 140. In the illustrated example, the illustrative hardhat 140 is configured with the hardhat speaker 135 right speaker 215 emitting sound waves 245 reflected by the right hardhat interior reflecting region 415 toward the user's ear location 420 within the hardhat 140.

Figure 5:
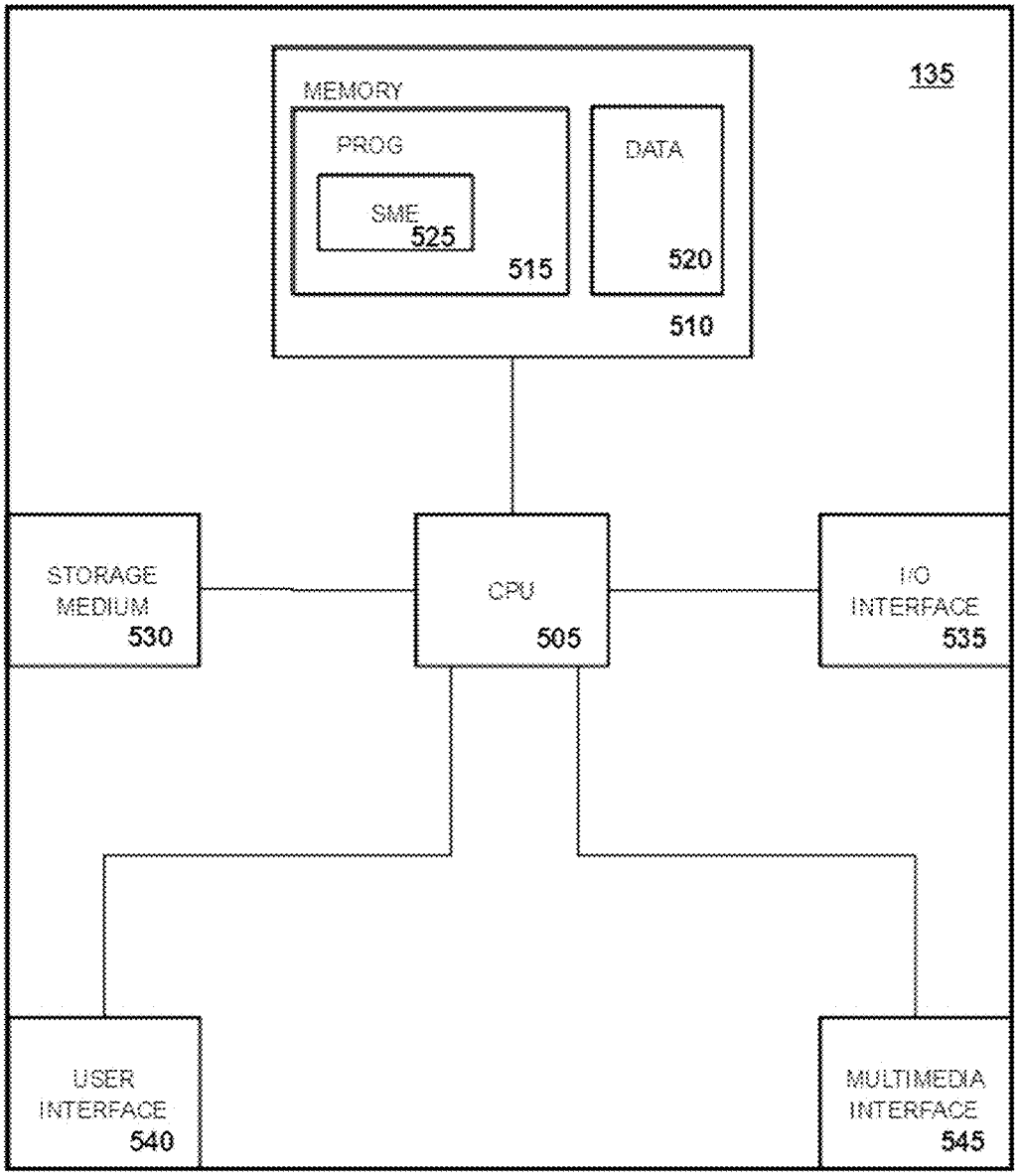
FIG. 5 depicts an illustrative structural block diagram of an embodiment wireless audio speaker module.

FIG. 5 depicts an illustrative structural block diagram of an embodiment wireless audio speaker module. In FIG. 5, the block diagram of the exemplary hardhat speaker 135 includes processor 505 and memory 510. The processor 505 is in electrical communication with the memory 510. The depicted memory 510 includes program memory 515 and data memory 520. The depicted program memory 515 includes processor-executable program instructions implementing the SME (Speaker Management Engine) 525. In various implementations, the SME 525 may include processor-executable program instructions configured to implement a wireless audio transceiver. In some designs, the SME 525 may include processor-executable program instructions configured to interactively execute user activated operational controls or indicators including buttons, switches, or lights configured to control or display disclosed hardhat speaker 135 functions. In some embodiments, the illustrated program memory 515 may include processor-executable program instructions configured to implement an OS (Operating System). In various embodiments, the OS may include processor executable program instructions configured to implement various operations when executed by the processor 505. In some embodiments, the OS may be omitted. In some embodiments, the illustrated program memory 515 may include processor-executable program instructions configured to implement various Application Software. In various embodiments, the Application Software may include processor executable program instructions configured to implement various operations when executed by the processor 505. In some embodiments, the Application Software may be omitted. In the depicted embodiment, the processor 505 is communicatively and operably coupled with the storage medium 530. In the depicted embodiment, the processor 505 is communicatively and operably coupled with the I/O (Input/Output) interface 535. In the depicted embodiment, the I/O interface 535 includes a network interface. In various implementations, the network interface may be a wireless network interface. In some designs, the network interface may be a Wi-Fi interface. In some embodiments, the network interface may be a Bluetooth interface. In an illustrative example, the hardhat speaker 135 may include more than one network interface. In some designs, the network interface may be a wireline interface. In some designs, the network interface may be omitted. In the depicted embodiment, the processor 505 is communicatively and operably coupled with the user interface 540. In various implementations, the user interface 540 may be adapted to receive input from a user or send output to a user. In various designs, the user interface 540 may include user accessible buttons, switches, or lights configured to control or display disclosed hardhat speaker 135 functions. In some embodiments, the user interface 540 may be adapted to an input-only or output-only user interface mode. In various implementations, the user interface 540 may include an imaging display. In some embodiments, the user interface 540 may include an audio interface. In some designs, the audio interface may include an audio input. In various designs, the audio interface may include an audio output. In some implementations, the user interface 540 may be touch-sensitive. In some designs, the hardhat speaker 135 may include an accelerometer operably coupled with the processor 505. In various embodiments, the hardhat speaker 135 may include a GPS module operably coupled with the processor 505. In an illustrative example, the hardhat speaker 135 may include a magnetometer operably coupled with the processor 505. In some embodiments, the user interface 540 may include an input sensor array. In various implementations, the input sensor array may include one or more imaging sensor. In various designs, the input sensor array may include one or more audio transducer. In some implementations, the input sensor array may include a radio-frequency detector. In an illustrative example, the input sensor array may include an ultrasonic audio transducer. In some embodiments, the input sensor array may include image sensing subsystems or modules configurable by the processor 505 to be adapted to provide image input capability, image output capability, image sampling, spectral image analysis, correlation, autocorrelation, Fourier transforms, image buffering, image filtering operations including adjusting frequency response and attenuation characteristics of spatial domain and frequency domain filters, image recognition, pattern recognition, or anomaly detection. In various implementations, the depicted memory 510 may contain processor executable program instruction modules configurable by the processor 505 to be adapted to provide image input capability, image output capability, image sampling, spectral image analysis, correlation, autocorrelation, Fourier transforms, image buffering, image filtering operations including adjusting frequency response and attenuation characteristics of spatial domain and frequency domain filters, image recognition, pattern recognition, or anomaly detection. In some embodiments, the input sensor array may include audio sensing subsystems or modules configurable by the processor 505 to be adapted to provide audio input capability, audio output capability, audio sampling, spectral audio analysis, correlation, autocorrelation, Fourier transforms, audio buffering, audio filtering operations including adjusting frequency response and attenuation characteristics of temporal domain and frequency domain filters, audio pattern recognition, or anomaly detection. In various implementations, the depicted memory 510 may contain processor executable program instruction modules configurable by the processor 505 to be adapted to provide audio input capability, audio output capability, audio sampling, spectral audio analysis, correlation, autocorrelation, Fourier transforms, audio buffering, audio filtering operations including adjusting frequency response and attenuation characteristics of temporal domain and frequency domain filters, audio pattern recognition, or anomaly detection. In the depicted embodiment, the processor 505 is communicatively and operably coupled with the multimedia interface 545. In the illustrated embodiment, the multimedia interface 545 includes interfaces adapted to input and output of audio, video, and image data. In some embodiments, the multimedia interface 545 may include one or more still image camera or video camera. In various designs, the multimedia interface 545 may include one or more microphone. In some implementations, the multimedia interface 545 may include a wireless communication means configured to operably and communicatively couple the multimedia interface 545 with a multimedia data source or sink external to the hardhat speaker 135. In various designs, the multimedia interface 545 may include interfaces adapted to send, receive, or process encoded audio or video. In various embodiments, the multimedia interface 545 may include one or more video, image, or audio encoder. In various designs, the multimedia interface 545 may include one or more video, image, or audio decoder. In various implementations, the multimedia interface 545 may include interfaces adapted to send, receive, or process one or more multimedia stream. In various implementations, the multimedia interface 545 may include a GPU. In some embodiments, the multimedia interface 545 may be omitted. In some embodiments, the I/O interface 535 and the multimedia interface 545 may comprise a wireless audio transceiver. Useful examples of the illustrated hardhat speaker 135 include, but are not limited to, personal computers, servers, tablet PCs, smartphones, or other computing devices. In some embodiments, multiple hardhat speaker 135 devices may be operably linked to form a computer network in a manner as to distribute and share one or more resources, such as clustered computing devices and server banks/farms. Various examples of such general-purpose multi-unit computer networks suitable for embodiments of the disclosure, their typical configuration and many standardized communication links are well known to one skilled in the art. In some embodiments, an exemplary hardhat speaker 135 design may be realized in a distributed implementation. In an illustrative example, some hardhat speaker 135 designs may be partitioned between a client device, such as, for example, a phone, and, a more powerful server system. In various designs, a hardhat speaker 135 partition hosted on a PC or mobile device may choose to delegate some parts of computation, such as, for example, machine learning or deep learning, to a host server. In some embodiments, a client device partition may delegate computation-intensive tasks to a host server to take advantage of a more powerful processor, or to offload excess work. In an illustrative example, some devices may be configured with a mobile chip including an engine adapted to implement specialized processing, such as, for example, neural networks, machine learning, artificial intelligence, image recognition, audio processing, or digital signal processing. In some embodiments, such an engine adapted to specialized processing may have sufficient processing power to implement some features. However, in some embodiments, an exemplary hardhat speaker 135 may be configured to operate on a device with less processing power, such as, for example, various gaming consoles, which may not have sufficient processor power, or a suitable CPU architecture, to adequately support hardhat speaker 135. Various embodiment designs configured to operate on a such a device with reduced processor power may work in conjunction with a more powerful server system.

Although various embodiments have been described with reference to the Figures, other embodiments are possible. For example, in various exemplary scenarios, some embodiment hardhat speaker implementations may be referred to as a HardBeatz Bluetooth Speaker. In an illustrative example, various HardBeatz Bluetooth Speaker designs may advantageously solve one or more problem. In an illustrative example, some HardBeatz Bluetooth Speaker implementations may provide construction grade personal audio in a Bluetooth speaker designed for a hardhat. For example, individuals working in or around construction sites may be required to wear a hardhat in order to maintain safety in the workplace. In an illustrative example, if an individual were to wish to listen to music using earphones, headphones, or the like, it can be difficult or impossible to do so while wearing the hardhat. Additionally, such in-ear listening devices may also distract the individual, leaving them unaware of their surroundings. One option may be for the individual to listen to a radio. However, this leads to multiple individuals being forced to listen to the same thing, which certain individuals may not desire. Being unable to listen to music throughout a workday can be exceptionally frustrating and make days extremely boring.

In an illustrative scenario exemplary of prior art usage, construction workers are tired of other tradesmen loudly listening to their personal radio and music. Workplace speakers can be a distraction and can bother coworkers and others sharing a jobsite. In-ear listening devices such as headphones and earbuds may be an option but can be a dangerous distraction, reducing awareness to the surrounding worksite. Often headphones are not allowed on construction sites, due to OSHA and other safety regulations. Construction and trades workers may ask the question, "Why work in silence?"

In order to address these concerns, various embodiments of the present invention provide a speaker attachment for a hardhat. Some embodiment Hard Beatz Bluetooth speaker designs may be configured to fit into a hard hat. In various embodiments, a Hard Beatz Bluetooth speaker design may be configured to fit into other helmets. Some embodiment Hard Beatz Bluetooth speaker implementations create a solution to workplace silence. In various examples, construction workers can listen to their music through an embodiment Bluetooth personal speaker system designed to fit inside of a hard hat, eliminating the need for any in-ear devices while reducing distractions without reducing productivity. Various embodiment Hard Beatz Bluetooth speaker designs provide construction grade personal audio. Some embodiment designs may include adjustable volume. Various implementations may include battery power, configured to be recharged using USB charging. Various embodiment Hardbeatz Bluetooth speaker implementations may be designed to mount inside of any hard hat easily and quickly. In an illustrative scenario exemplary of some embodiments' usage, an embodiment HardBeatz Bluetooth interface may easily connect to any personal audio device. In some illustrative examples, the dual speakers may play music in crisp clear stereo using the hard hat as an amplifier. For example, in various scenarios, an embodiment Hardbeatz speaker may only emit enough sound to keep the wearer entertained, while keeping workplace distraction to a minimum, allowing for listening during a wide range of activities.

Various embodiments of the present invention provide a speaker attachment for a hardhat. Some embodiment designs may include a housing having a front surface, a rear surface, and a plurality of sidewalls defining a triangular prism. In some designs, a pair of speakers may be disposed on the front surface. Various embodiments may include a fastener disposed on the rear surface. In some embodiments, the fastener may be configured to removably secure the housing within a hardhat. In various exemplary scenarios, some embodiments of the present invention may allow individuals to listen to their own music while wearing a hardhat, without the need for headphones or earbuds.

Referring now to FIGS. 3A-3C, there is shown an exemplary front, rear, and side view of an embodiment speaker attachment for a hardhat. The depicted embodiment device includes a power supply and an operatively connected speaker disposed in a triangular prism housing. In the illustrated embodiment, a port is disposed on the housing for recharging the power supply. In the depicted embodiment, the speakers protrude from a top surface of the prism. In the illustrated embodiment, a right and left speaker is included, and the operational buttons of the device are disposed between each speaker, such as a power button, indicator light, and the like.

In the embodiment depicted by FIGS. 3A-3C, the bottom surface of the prism is removably securable to an inner surface of a helmet or hard hat. In the illustrated embodiment, the speaker is securable to the hard hat via a hook and loop fastener. However, other suitable fasteners may be utilized. In an illustrative example, the speaker is preferably removably secured within the hardhat so that it can be removed and recharged when not needed. In the depicted embodiment, the speaker attachment further includes a wireless transceiver, such as a Bluetooth transceiver, which is operatively connected to the power supply. In the illustrated embodiment, the wireless transceiver is configured to wirelessly communicate with a media device such as a smartphone. In various exemplary scenarios, the wireless transceiver may receive an audio signal from a media device, and play the audio through the speaker. In various embodiment implementations, the housing may include one or more control configured to control the media device, such as selecting a particular song to be played. In various scenarios, exemplary hardhat speaker embodiment designs may provide users with a means for listening to music while wearing a hardhat, without the need for earphones or earbuds.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. Some exemplary embodiments were chosen and described in order to best explain the principles of the present invention and its practical application, to thereby enable others skilled in the art to best utilize the present invention and various embodiments with various modifications as are suited to the particular use contemplated.

In the Summary above and in this Detailed Description, and the Claims below, and in the accompanying drawings, reference is made to particular features of various embodiments of the invention. It is to be understood that the disclosure of embodiments of the invention in this specification includes all possible combinations of such particular features. For example, where a particular feature is disclosed in the context of a particular aspect or embodiment of the invention, or a particular claim, that feature can also be used—to the extent possible—in combination with and/or in the context of other particular aspects and embodiments of the invention, and in the invention generally.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments.

In the present disclosure, various features may be described as being optional, for example, through the use of the verb "may;", or, through the use of any of the phrases: "in some embodiments," "in some implementations," "in some designs," "in various embodiments," "in various implementations,", "in various designs," "in an illustrative example," or "for example;" or, through the use of parentheses. For the sake of brevity and legibility, the present disclosure does not explicitly recite each and every permutation that may be obtained by choosing from the set of optional features. However, the present disclosure is to be interpreted as explicitly disclosing all such permutations. For example, a system described as having three optional features may be embodied in seven different ways, namely with just one of the three possible features, with any two of the three possible features or with all three of the three possible features.

In various embodiments. elements described herein as coupled or connected may have an effectual relationship realizable by a direct connection or indirectly with one or more other intervening elements.

In the present disclosure, the term "any" may be understood as designating any number of the respective elements, i.e. as designating one, at least one, at least two, each or all of the respective elements. Similarly, the term "any" may be understood as designating any collection(s) of the respective elements, i.e. as designating one or more collections of the respective elements, a collection comprising one, at least one, at least two, each or all of the respective elements. The respective collections need not comprise the same number of elements.

While various embodiments of the present invention have been disclosed and described in detail herein, it will be apparent to those skilled in the art that various changes may be made to the configuration, operation and form of the invention without departing from the spirit and scope thereof. In particular, it is noted that the respective features of embodiments of the invention, even those disclosed solely in combination with other features of embodiments of the invention, may be combined in any configuration excepting those readily apparent to the person skilled in the art as nonsensical. Likewise, use of the singular and plural is solely for the sake of illustration and is not to be interpreted as limiting.

In the present disclosure, all embodiments where "comprising" is used may have as alternatives "consisting essentially of," or "consisting of" In the present disclosure, any method or apparatus embodiment may be devoid of one or more process steps or components. In the present disclosure, embodiments employing negative limitations are expressly disclosed and considered a part of this disclosure.

Certain terminology and derivations thereof may be used in the present disclosure for convenience in reference only and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

The term "comprises" and grammatical equivalents thereof are used herein to mean that other components, ingredients, steps, among others, are optionally present. For example, an embodiment "comprising" (or "which comprises") components A, B and C can consist of (i.e., contain only) components A, B and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose limit is the second number. For example, 25 to 100 mm means a range whose lower limit is 25 mm and upper limit is 100 mm.

Many suitable methods and corresponding materials to make each of the individual parts of embodiment apparatus are known in the art. According to an embodiment of the present invention, one or more of the parts may be formed by machining, 3D printing (also known as "additive" manufacturing), CNC machined parts (also known as "subtractive" manufacturing), and injection molding, as will be apparent to a person of ordinary skill in the art. Metals, wood, thermoplastic and thermosetting polymers, resins and elastomers as may be described herein-above may be used. Many suitable materials are known and available and can be selected and mixed depending on desired strength and flexibility, preferred manufacturing method and particular use, as will be apparent to a person of ordinary skill in the art.

Any element in a claim herein that does not explicitly state "means for" performing a specified function, or "step for" performing a specific function, is not to be interpreted as a "means" or "step" clause as specified in 35 U.S.C. § 112 (f). Specifically, any use of "step of" in the claims herein is not intended to invoke the provisions of 35 U.S.C. § 112 (f).

According to an embodiment of the present invention, the system and method may be accomplished through the use of one or more computing devices. As depicted, for example, at least in FIG. 1, and FIG. 5, one of ordinary skill in the art would appreciate that an exemplary system appropriate for use with embodiments in accordance with the present application may generally include one or more of a Central processing Unit (CPU), Random Access Memory (RAM), a storage medium (e.g., hard disk drive, solid state drive, flash memory, cloud storage), an operating system (OS), one or more application software, a display element, one or more communications means, or one or more input/output devices/means. Examples of computing devices usable with embodiments of the present invention include, but are not limited to, proprietary computing devices, personal computers, mobile computing devices, tablet PCs, mini-PCs, servers or any combination thereof. The term computing device may also describe two or more computing devices communicatively linked in a manner as to distribute and share one or more resources, such as clustered computing devices and server banks/farms. One of ordinary skill in the art would understand that any number of computing devices could be used, and embodiments of the present invention are contemplated for use with any computing device.

In various embodiments, communications means, data store(s), processor(s), or memory may interact with other components on the computing device, in order to effect the provisioning and display of various functionalities associated with the system and method detailed herein. One of ordinary skill in the art would appreciate that there are numerous configurations that could be utilized with embodiments of the present invention, and embodiments of the present invention are contemplated for use with any appropriate configuration.

According to an embodiment of the present invention, the communications means of the system may be, for instance, any means for communicating data over one or more networks or to one or more peripheral devices attached to the system. Appropriate communications means may include, but are not limited to, circuitry and control systems for providing wireless connections, wired connections, cellular connections, data port connections, Bluetooth connections, or any combination thereof. One of ordinary skill in the art would appreciate that there are numerous communications means that may be utilized with embodiments of the present invention, and embodiments of the present invention are contemplated for use with any communications means.

Throughout this disclosure and elsewhere, block diagrams and flowchart illustrations depict methods, apparatuses (i.e., systems), and computer program products. Each element of the block diagrams and flowchart illustrations, as well as each respective combination of elements in the block diagrams and flowchart illustrations, illustrates a function of the methods, apparatuses, and computer program products. Any and all such functions ("depicted functions") can be implemented by computer program instructions; by special-purpose, hardware-based computer systems; by combinations of special purpose hardware and computer instructions; by combinations of general purpose hardware and computer instructions; and so on—any and all of which may be generally referred to herein as a "circuit," "module," or "system."

While the foregoing drawings and description may set forth functional aspects of the disclosed systems, no particular arrangement of software for implementing these functional aspects should be inferred from these descriptions unless explicitly stated or otherwise clear from the context.

Each element in flowchart illustrations may depict a step, or group of steps, of a computer-implemented method. Further, each step may contain one or more sub-steps. For the purpose of illustration, these steps (as well as any and all other steps identified and described above) are presented in order. It will be understood that an embodiment can contain an alternate order of the steps adapted to a particular application of a technique disclosed herein. All such variations and modifications are intended to fall within the scope of this disclosure. The depiction and description of steps in any particular order is not intended to exclude embodiments having the steps in a different order, unless required by a particular application, explicitly stated, or otherwise clear from the context.

Traditionally, a computer program consists of a sequence of computational instructions or program instructions. It will be appreciated that a programmable apparatus (i.e., computing device) can receive such a computer program and, by processing the computational instructions thereof, produce a further technical effect.

A programmable apparatus may include one or more microprocessors, microcontrollers, embedded microcontrollers, programmable digital signal processors, programmable devices, programmable gate arrays, programmable array logic, memory devices, application specific integrated circuits, or the like, which can be suitably employed or configured to process computer program instructions, execute computer logic, store computer data, and so on. Throughout this disclosure and elsewhere a computer can include any and all suitable combinations of at least one general purpose computer, special-purpose computer, programmable data processing apparatus, processor, processor architecture, and so on.

It will be understood that a computer can include a computer-readable storage medium and that this medium may be internal or external, removable and replaceable, or fixed. It will also be understood that a computer can include a Basic Input/Output System (BIOS), firmware, an operating system, a database, or the like that can include, interface with, or support the software and hardware described herein.

Embodiments of the system as described herein are not limited to applications involving conventional computer programs or programmable apparatuses that run them. It is contemplated, for example, that embodiments of the invention as claimed herein could include an optical computer, quantum computer, analog computer, or the like.

Regardless of the type of computer program or computer involved, a computer program can be loaded onto a computer to produce a particular machine that can perform any and all of the depicted functions. This particular machine provides a means for carrying out any and all of the depicted functions.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain or store a program for use by or in connection with an instruction execution system, apparatus, or device.

Computer program instructions can be stored in a computer-readable memory capable of directing a computer or other programmable data processing apparatus to function in a particular manner. The instructions stored in the computer-readable memory constitute an article of manufacture including computer-readable instructions for implementing any and all of the depicted functions.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

The elements depicted in flowchart illustrations and block diagrams throughout the figures imply logical boundaries between the elements. However, according to software or hardware engineering practices, the depicted elements and the functions thereof may be implemented as parts of a monolithic software structure, as standalone software modules, or as modules that employ external routines, code, services, and so forth, or any combination of these. All such implementations are within the scope of the present disclosure.

Unless explicitly stated or otherwise clear from the context, the verbs "execute" and "process" are used interchangeably to indicate execute, process, interpret, compile, assemble, link, load, any and all combinations of the foregoing, or the like. Therefore, embodiments that execute or process computer program instructions, computer-executable code, or the like can suitably act upon the instructions or code in any and all of the ways just described.

The functions and operations presented herein are not inherently related to any particular computer or other apparatus. Various general-purpose systems may also be used with programs in accordance with the teachings herein, or it may prove convenient to construct more specialized apparatus to perform the required method steps. The required structure for a variety of these systems will be apparent to those of skill in the art, along with equivalent variations. In addition, embodiments of the invention are not described with reference to any particular programming language. It is appreciated that a variety of programming languages may be used to implement the present teachings as described herein, and any references to specific languages are provided for disclosure of enablement and best mode of embodiments of the invention. Embodiments of the invention are well suited to a wide variety of computer network systems over numerous topologies. Within this field, the configuration and management of large networks include storage devices and computers that are communicatively coupled to dissimilar computers and storage devices over a network, such as the Internet.

A number of implementations have been described. Nevertheless, it will be understood that various modifications may be made. For example, advantageous results may be achieved if the steps of the disclosed techniques were performed in a different sequence, or if components of the disclosed systems were combined in a different manner, or if the components were supplemented with other components. Accordingly, other implementations are contemplated within the scope of the following claims.

What is claimed is:

1. An apparatus, comprising:

a wireless audio speaker module adapted to be retained within a headgear to permit a headgear user to listen to music amplified by the headgear interior reflecting sound from the speaker to the user's ear within the headgear, comprising:

a housing, comprising a substantially triangular-prism-shaped structure; and, a wireless audio speaker substantially retained by the housing; the wireless audio speaker comprising:

an audio speaker; and, a wireless audio transceiver operably coupled with the audio speaker to play through the audio speaker a music signal received by the wireless audio transceiver.

2. The apparatus of claim 1, wherein the audio speaker is disposed to emit sound dispersing from a plane substantially conformant with the plane defined by a prism side of the substantially triangular-prism-shaped housing.

3. The apparatus of claim 1, wherein the audio speaker is disposed to emit sound dispersing from at least two points colinear with an axis substantially perpendicular to the plane defined by a prism side of the substantially triangular-prism-shaped housing.

4. The apparatus of claim 1, wherein the audio speaker further comprises dual speakers configured to play music in stereo.

5. The apparatus of claim 1, wherein the wireless audio transceiver further comprises more than one signal channel.

6. The apparatus of claim 1, wherein the headgear is a hardhat.

7. The apparatus of claim 1, wherein the apparatus further comprises a headgear retaining the wireless audio speaker module.

8. The apparatus of claim 1, wherein the apparatus further comprises a power supply operably coupled with the wireless audio transceiver.

9. The apparatus of claim 1, wherein the apparatus further comprises a rechargeable battery operably coupled with the wireless audio transceiver.

10. An apparatus, comprising:

a wireless audio speaker module adapted to be retained within a headgear to permit a headgear user to listen to music amplified by the headgear interior reflecting sound from the speaker to the user's ear within the headgear, comprising:

a housing, comprising a substantially triangular-prism-shaped structure;

and, a wireless audio speaker substantially retained by the housing; the wireless audio speaker comprising:

an audio speaker, comprising dual speakers configured to play music in stereo, each of the audio speakers disposed to emit sound dispersing from a plane substantially conformant with the plane defined by a prism side of the substantially triangular-prism-shaped housing;

a wireless audio transceiver operably coupled with the audio speaker to play through the audio speaker a stereo music signal received by the wireless audio transceiver; and, a rechargeable battery operably coupled with the wireless audio transceiver.

11. The apparatus of claim 10, wherein the audio speaker is disposed to emit sound dispersing from at least two points colinear with an axis substantially perpendicular to the plane defined by a prism side of the substantially triangular-prism-shaped housing.

12. The apparatus of claim 10, wherein the wireless audio transceiver further comprises a Bluetooth interface configured to operably couple with a smartphone to play through the audio speaker a stereo music signal received by the wireless audio transceiver from a smartphone.

13. The apparatus of claim 10, wherein the apparatus further comprises a charging port operably coupled with the rechargeable battery.

14. The apparatus of claim 10, wherein the housing further comprises a fastener configured to removably secure the housing to a headgear interior surface.

15. The apparatus of claim 10, wherein the apparatus further comprises a power button operably coupled with the wireless transceiver.

16. The apparatus of claim 10, wherein the apparatus further comprises an indicator light operably coupled with the wireless transceiver.

17. An apparatus, comprising:

a wireless audio speaker module adapted to be retained within a headgear to permit a headgear user to listen to music amplified by the headgear interior reflecting sound from the speaker to the user's ear within the headgear, comprising:

a housing, comprising: a substantially triangular-prism-shaped structure, comprising:

a front surface, comprising two substantially rectangular prism sides of the substantially triangular-prism-shaped housing, the substantially rectangular prism sides longitudinally conjoined along prism side edges disposed substantially parallel with the housing's longitudinal central axis;

a rear surface, comprising a substantially planar structure section; and, a plurality of sidewalls substantially defining a triangle, structurally engaging the front surface with the rear surface to form a substantially triangular prism; and, a wireless audio speaker substantially retained by the housing; the wireless audio speaker comprising:

an audio speaker, comprising dual speakers configured to play music in stereo, each of the audio speakers disposed to emit sound dispersing from a plane substantially conformant with the plane defined by a prism side surface of the substantially triangular-prism-shaped housing;

a wireless audio transceiver operably coupled with the audio speaker to play through the audio speaker a stereo music signal received by the wireless audio transceiver, the wireless audio transceiver including a Bluetooth interface configured to operably couple with a smartphone to play through the audio speaker a stereo music signal received by the wireless audio transceiver from a smartphone;

a rechargeable battery operably coupled with the wireless audio transceiver; and, a charging port operably coupled with the rechargeable battery.

18. The apparatus of claim 17, wherein the audio speaker is disposed to emit sound dispersing from at least two points colinear with an axis substantially perpendicular to the plane defined by a prism side surface of the substantially triangular-prism-shaped housing.

19. The apparatus of claim 17, wherein the angle between the plane defined by a prism side surface of the substantially triangular-prism-shaped housing and the plane perpendicular to the housing centerline and opposite the housing rear surface is between ten degrees and seventy degrees.

20. The apparatus of claim 17, wherein the housing rear surface further comprises a fastener configured to removably secure the housing to a headgear interior surface.

* * * * *